United States Patent [19]

Mobbs

[11] Patent Number: 4,789,081

[45] Date of Patent: Dec. 6, 1988

[54] DRINKING STRAW DISPENSERS

[76] Inventor: Christopher R. Mobbs, 4 Jayne Street, West Ryde, N.S.W., 2114, Australia

[21] Appl. No.: 61,704

[22] Filed: Jun. 11, 1987

[30] Foreign Application Priority Data

Jun. 11, 1986 [AU] Australia ..... PH6353

[51] Int. Cl.[4] ..... B65D 83/02; B65D 85/08

[52] U.S. Cl. ..... 221/281; 221/285; 221/305; 206/443; 312/73

[58] Field of Search ..... 221/191, 281, 285, 303, 221/305, 309; 312/45, 72, 73; 206/443

[56] References Cited

U.S. PATENT DOCUMENTS

| | | | |
|---|---|---|---|
| D. 254,530 | 3/1980 | Armstrong | 312/45 X |
| 319,322 | 6/1885 | Roberts | 312/73 |
| 926,581 | 6/1909 | Lewis et al. | 312/73 |
| 3,219,244 | 11/1965 | Blask | 221/309 X |
| 4,148,413 | 4/1979 | Immordino | 221/305 X |

*Primary Examiner*—F. J. Bartuska

*Attorney, Agent, or Firm*—Kane, Dalsimer, Sullivan, Kurucz, Levy, Eisele and Richard

[57] ABSTRACT

A dispenser for drinking straws is disclosed. The dispenser is a container which includes a front panel and an inclined bottom panel so that the straws within roll toward the front and pass through an elongated aperture. The leading straw rests against a rib projecting upward from the end of the bottom panel and blocks the aperture to retain the remaining straws within the container. Also included are a closure panel, hinged to a back panel, which allows access to the inside of the container, and side walls, which extend below the container to form supporting legs. A central opening enables one to grasp a straw by its central portion. The container is formed by the injection moulding of a plastic material in a single, substantially flat, unfolded sheet with a number of fold lines. Assembly is carried out by folding the sheet along the fold lines with the ends of the front panel positively engaging with the side walls.

6 Claims, 3 Drawing Sheets

DRINKING STRAW DISPENSERS

FIELD OF INVENTION

The invention relates to dispensers for drinking straws, particularly dispensers suitable for use in commercial establishments such as milk bars, drug-stores, hotels, restuarants, taverns and the like. In those establishments, drinking straws may be dispensed either by staff or customers.

DESCRIPTION OF THE PRIOR ART

Many commercial establishments offering drinking straws for customer use do not provide special drinking straw dispensers. Drinking straws are held in an upright or inclined disposition in an open-ended vessel such since a drinking glass or a mug or the like. This practise is unhygienic as all of the drinking straws are exposed to atmospheric contamination. Furthermore, the ends of several straws are usually handled whenever one or more straws are extracted. When customers rather than staff extract straws, the hygiene problem is increased.

In one known dispenser, the straws are carried, substantially upright, on a movable support within a cylindrical container. The support is raised to expose the upper ends of the straws above the rim of the container for selection by a user. While this reduces the exposure problem, this type of dispenser suffers from the disadvantage caused by the handling of the ends of several straws by different users.

In another known dispenser, the straws are disposed substantially horizontally within a container provided with an aperture through which a straw may roll onto a resting ledge. Near to its centre, the ledge is broken away thereby exposing the central portion of a straw for handling by a user. In dispensers of this type, the risk of different people handling the ends of straws is minimised. Dispensers of this type have previously been made of metal. They are relatively costly to manufacture and are bulky products to transport and store.

Dispensers have been made with a number of moving parts to assist the dispensing action. This increases the cost of a dispenser and frequently causes the dispensers to be unreliable in operation, particularly in the case of a slightly bent straw.

BRIEF SUMMARY OF THE INVENTION

It is an object of the invention to provide a drinking straw dispenser which is relatively hygienic in use, reliable in operation, inexpensive to produce and requires a minimum amount of storage space at the place of manufacture, during transportation and warehousing. It is also an object of the invention to provide a drinking straw dispenser in which the dispensing action is not dependent upon moving parts.

Accordingly, a dispenser for drinking straws includes a container adapted to accommodate a plurality of straws in a substantially horizontal disposition, said container comprising a plurality of longitudinal panels, including a bottom panel, a front panel and a closure panel, attached at the ends thereof to a pair of similar upright side walls, said bottom panel inclined so that straws will roll towards the front of the container, said front panel extending upwardly from the bottom panel and having a bottom edge connected at its ends to the bottom panel, an intermediate portion of the bottom edge of the front panel being spaced from the bottom panel to form an aperture through which a straw may roll out from the container, the bottom panel extending forwardly of the front panel, a rib extending upwardly from the front edge of the bottom panel to provide a rest for a straw so that a straw resting against the rib will block the aperture so that the remainder of the straws are retained in the container, characterised in that the panels of the container are formed by injection moulding plastics material in a single substantially flat unfolded sheet with a plurality of predetermined fold lines, the dispenser being formed by folding the sheet along said fold lines with ends of the panel positively interengaging with the side walls to form a substantially rigid construction.

The invention also includes a method of making that dispenser and a sheet blank of plastics material from which such a dispenser may be formed.

BRIEF DESCRIPTION OF THE DRAWINGS

One embodiment of dispenser according to the invention is illustrated in the accompanying drawings, in which.

DETAILED DESCRIPTION

In this specification, "front", "bottom", "horizontal", "upright" and similar terms refer to a dispenser in assembled condition standing on a horizontal surface. The longitudinal dimension of the container is substantially parallel to the longitudinal dimension of the drinking straws accommodated therein. Straws are dispensed at the front of the container.

Figure 1:
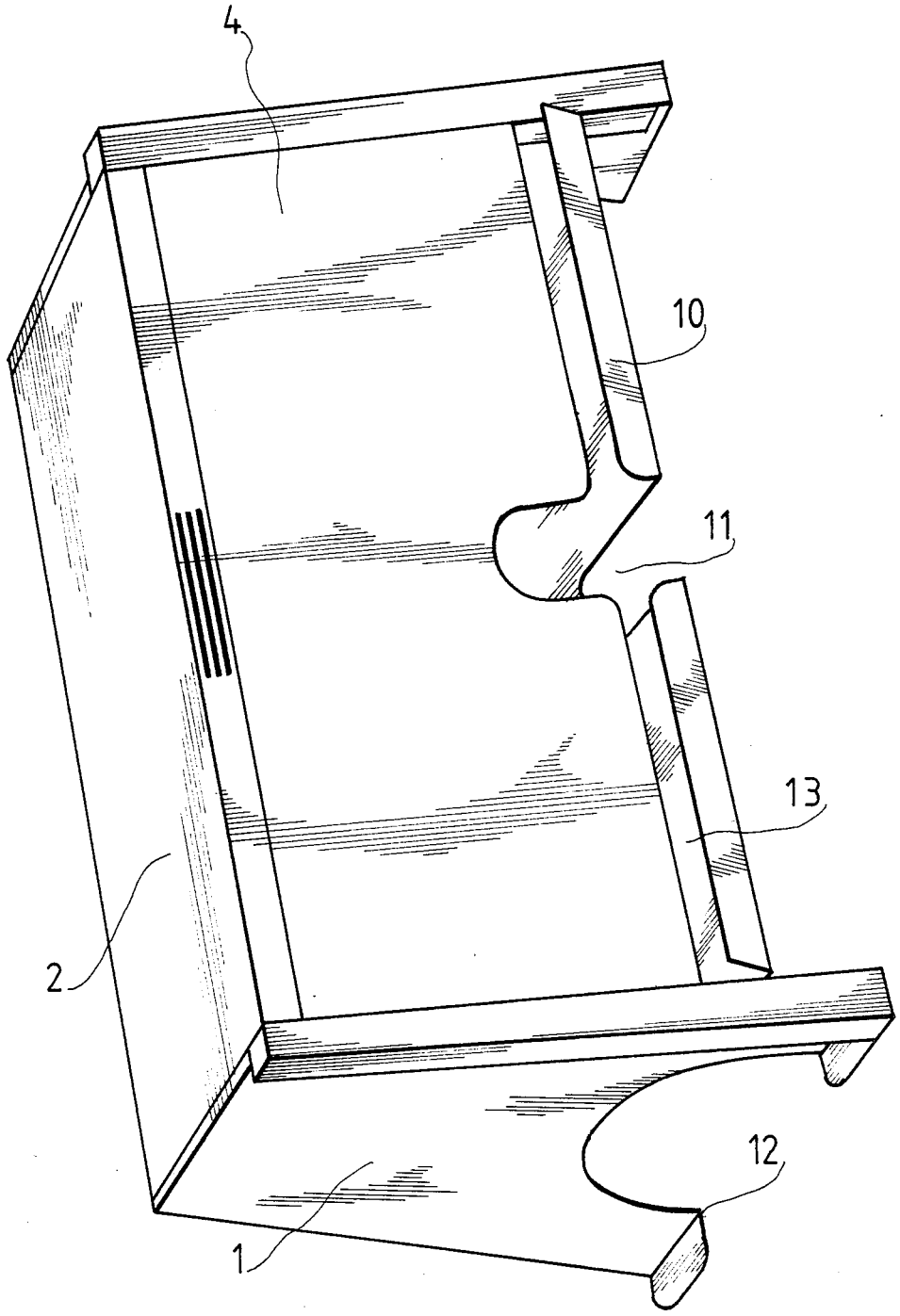
FIG. 1 is a perspective view of a dispenser in assembled condition.
Figure 4:
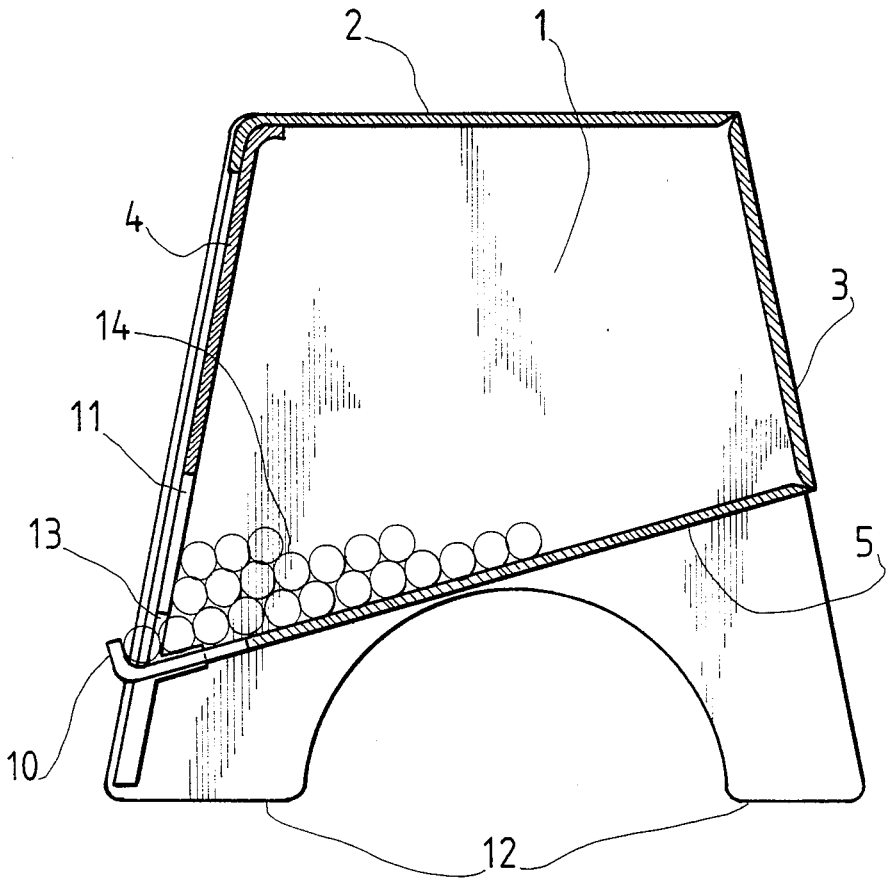
FIG. 4 is a transverse sectional view through the middle of the assembled container of FIG. 1.

An assembled dispenser for drinking straws is illustrated in FIGS. 1 and 4. This dispenser includes a container adapted to accommodate a plurality of drinking straws 14 in a substantially horizontal disposition. The container comprises a pair of similar side walls 1, a closure panel 2, a back panel 3, a front panel 4, and a bottom panel 5. The side walls 1 extend below the container to form supporting legs 12 for the dispenser. This positions the front of bottom panel 5 at a height convenient for straw extraction. As illustrated, closure panel 2 is in the form of a lid which is hinged to the top edge of the back panel 3.

Figure 2:
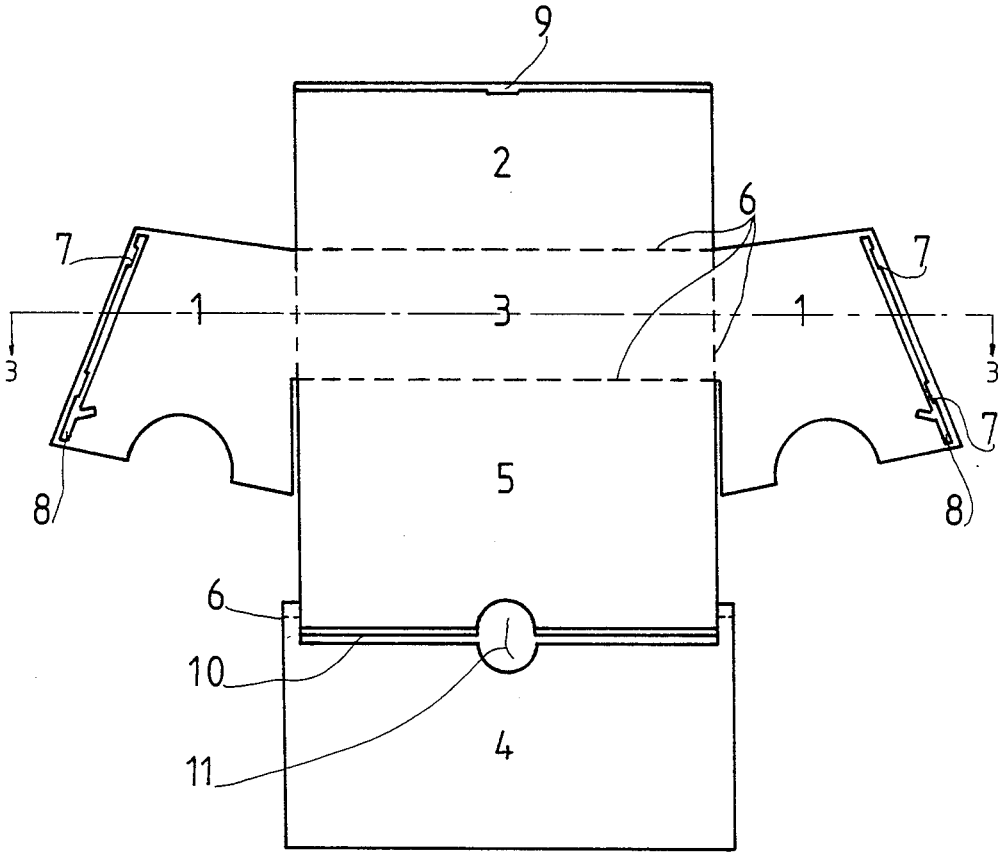
FIG. 2 is a plan view of a substantially flat one-piece moulding in the form of an unfolded sheet which may be folded along predetermined fold lines to form the dispenser of FIG. 1.

The bottom panel 5 inclines downwardly towards the front of the container so that straws which are accommodated within the container will roll towards the front thereof. The front panel 4 extends upwardly from the bottom panel 5. The bottom edge of front panel 4 is connected at its ends to the bottom panel 5 (see FIG. 2). The intermediate portion of the bottom edge of front panel 4 is spaced from bottom panel 5 to form an aperture 13 through which a straw may roll out from the container. The height of the aperture slightly exceeds the diameter of a straw. Bottom panel 5 extends at its front end forwardly of front panel 4 and a rib 10 extends upwardly from the front edge of bottom panel 5 to provide a rest for a straw. The parts are so dimensioned that a straw resting on rib 10 will block aperture 13 so that the remainder of the straws are retained in the container.

Mating openings 11 are formed in the bottom portion of front panel 4 and the forward portion of bottom panel 5. Thus a straw resting against rib 10 has its central portion exposed to facilitate handling by a user of the dispenser.

Figure 3:
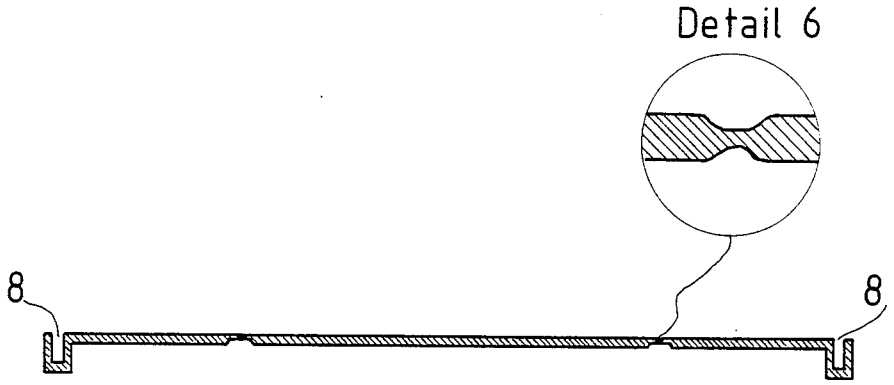
FIG. 3 is a section along the line 3—3 of FIG. 2 and including an enlarged view illustrating a fold line.

In the embodiment, both side walls 1, closure panel or lid 2, back panel 3, bottom panel 5, and front panel 4 are formed by injecting moulding plastics material in a single substantially flat unfolded sheet with a plurality of predetermined fold lines 6. There are longitudinal fold lines between closure panel or lid 2 and back panel 3 and between back panel 3 and bottom panel 5. There are also two short longitudinal fold lines between front panel 4 and projections on bottom panel 5. There are transverse fold lines between the ends of back panel 3 and each of side walls 1, respectively. The thickness of the moulded sheet is reduced along the fold lines as illustrated in the detail shown in FIG. 3.

A substantially U-shaped pocket (shown in section in FIG. 3) is formed during the moulding process along the upright side of each side wall 1. In the assembling operation, those pockets 8 are adapted to receive the ends of front panel 4. Each pocket 8 has a short branch pocket to receive the ends of the projections of bottom panel 5. Moulded within pockets 8 are suitable interference latches 7 to facilitate snap-fastening of the ends of front panel 4 in pockets 8 to provide a substantially rigid assembled construction.

The fold between closure panel 2 and back panel 3 acts as a hinge to allow opening and closing of closure panel or lid 2. Lid 2 is provided during the moulding operation with interference latch 9 so that lid 2 may be retained in its closed position. Opening lid 2 allows access to the interior of the container for filling it with straws.

Assembling the dispenser is effected by folding along the longitudinal fold lines 6 so that the panels are disposed relatively to one another in the manner shown in FIG. 4. By folding along the transverse fold lines 6, side walls 1 are moved into position and the ends of front panel 4 and the projections of bottom panel 5 are fitted into their respective pockets with a snap fit. By this means, a dispenser of substantially rigid construction is formed. If extra stability is required for the assembled dispenser, this may be achieved by providing pressure sensitive tape to the feet of legs 12 or by attaching a suitable weight to the underside of bottom panel 5.

The sheet may be injection moulded from any suitable plastics material and polypropylene is preferred. It is also possible to use a laminate of plastics material and some other material such as cardboard. Whereas one embodiment of the invention has been described, it is emphasised that various changes and modifications may be made within the broad concepts of the invention defined in the appended claims. For example, side walls 1 may be formed separately and from different material to the remainder of the dispenser. The side walls could be fastened to the main body by hinging clips which could be moulded in situ. Instead of the interference latches described, the dispenser may be held in assembled condition by tab or glue fastening. Although the dispenser has been described in relation to drinking straws, it is obvious that a similar dispenser may be used for other elongated articles, such as chopsticks for which there are similar hygiene considerations.

I claim:

1. A dispenser for drinking straws including a container adapted to accommodate a plurality of straws in a substantially horizontal disposition, said container comprising a plurality of longitudinal panels, including a bottom panel, a front panel, a back panel and closure panel, attached at the ends thereof to a pair of similar upright side walls, said bottom panel inclined so that straws will roll towards the front of the container, said front panel extending upwardly from the bottom panel and having a bottom edge connected at its ends to the bottom panel, an intermediate portion of the bottom edge of the front panel being spaced from the bottom panel to form an aperture through which a straw may roll out from the container, the bottom panel extending forwardly of the front panel, a rib extending upwardly from the front edge of the bottom panel to provide a rest for a straw so that a straw resting against the rib will block the aperture so that the remainder of the straws are retained in the container, characterized in that the side walls extend below the container to form two supporting legs therefor and position the front of the bottom panel at a height convenient for straw extraction, and characterized in that the panels and the side walls of the container are formed by injection moulding plastics material in a single substantially flat unfolded sheet with a plurality of predetermined fold lines, the dispenser being formed by folding the sheet along said fold lines with ends of the panels positively interengaging with the side walls to form a substantially rigid construction.

2. A dispenser according to claim 1, characterised in that, near to the middle of the aperture, mating openings are formed in the bottom portion of the front panel and in the front portion of the bottom panel to facilitate grasping the central portion of a straw.

3. A dispenser according to claim 1, characterized in that the closure panel comprises a hinged lid, and an interference latch to retain said hinged lid in its closed position.

4. A method of making a dispenser for drinking straws which includes a container adapted to accommodate a plurality of straws in a substantially horizontal disposition, said container comprising a plurality of longitudinal panels, including a bottom panel, a front panel, a back panel and a closure panel, attached at the ends thereof to a pair of similar upright side walls, each said side wall extending below the container to form two legs therefor and to position the front of the bottom panel at a height convenient for straw extraction, said bottom panel inclined so that straws will roll towards the front of the container, said front panel extending upwardly from the bottom panel and having a bottom edge connected at its ends to the bottom panel, an intermediate portion of the bottom edge of the front panel being spaced from the bottom panel to form an aperture through which a straw may roll out from the container, the bottom panel extending forwardly of the front panel, a rib extending upwardly from the front edge of the bottom panel to provide a rest for a straw so that a straw resting against the rib will block the aperture so that the remainder of the straws are retained in the container, said method being characterized in that the panels and the side walls of the container are formed by injection moulding plastics material in a single substantially flat unfolded sheet with a plurality of predetermined fold lines, the dispenser being formed by folding the sheet along said fold lines with ends of the panels positively interengaging with the side walls to form a substantially rigid construction.

5. The method according to claim 4, further comprising the steps of hingedly connecting said closure panel to the top of said back panel, thus forming a lid and providing said closure panel with an interference latch to retain it in its closed position.

6. A blank formed by injection moulding plastics material in a single substantially flat unfolded sheet for making a dispenser for drinking straws which includes a container adapted to accommodate a plurality of straws in a substantially horizontal disposition, said container comprising a plurality of longitudinal panels, including a bottom panel, a front panel, a back panel, and a closure panel, attached at the ends thereof to a pair of similar upright side walls, each said side wall extending below the container to form two legs therefor and to position the front of the bottom panel at a height convenient for straw extraction, said bottom panel inclined so that straws will roll towards the front of the container, said front panel extending upwardly from the bottom panel and having a bottom edge connected at its ends to the bottom panel, an intermediate portion of the bottom edge of the front panel being spaced from the bottom panel to form an aperture through which a straw may roll out from the container, the bottom panel extending forwardly of the front panel, a rib extending upwardly from the front edge of the bottom panel to provide a rest for a straw so that a straw resting against the rib will block the aperture so that the remainder of the straws are retained in the container, said blank being characterized in that said sheet includes the panels and the side walls of the container and is formed with a plurality of predetermined fold lines so that the dispenser may be formed by folding the sheet along said fold lines and positively interengaging the ends of the panels with the side walls to form a substantially rigid construction.

* * * * *